US012383952B2

(12) United States Patent
Bauer et al.

(10) Patent No.: US 12,383,952 B2
(45) Date of Patent: Aug. 12, 2025

(54) METHOD AND APPARATUS FOR FEEDING AN ELONGATE WORKPIECE TO A FORMING MACHINE

(71) Applicant: WAFIOS Aktiengesellschaft, Reutlingen (DE)

(72) Inventors: Martin Bauer, Ammerbuch (DE); Andreas Gönninger, Grafenberg (DE); Oliver Kuhnert, Wannweil (DE); Robin Sautter, Pfullingen (DE); Peter Schwellbach, Bisingen (DE); Tobias Single, Dettingen (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 231 days.

(21) Appl. No.: 18/029,691

(22) PCT Filed: Sep. 2, 2021

(86) PCT No.: PCT/EP2021/074294

§ 371 (c)(1),
(2) Date: Mar. 31, 2023

(87) PCT Pub. No.: WO2022/069145

PCT Pub. Date: Apr. 7, 2022

(65) Prior Publication Data

US 2024/0091845 A1 Mar. 21, 2024

(30) Foreign Application Priority Data

Oct. 2, 2020 (DE) ..... 102020212480.9

(51) Int. Cl.

| | |
|---|---|
| ***B21F 23/00*** | (2006.01) |
| ***B21C 47/24*** | (2006.01) |
| ***B21F 1/02*** | (2006.01) |

(52) U.S. Cl.
CPC ..... *B21F 23/005* (2013.01); *B21F 23/002* (2013.01)

(58) Field of Classification Search
CPC ..... B21F 23/005; B21F 23/002; B21F 23/00; B21F 1/02; B21C 47/24; B21C 47/245
See application file for complete search history.

(56) References Cited

U.S. PATENT DOCUMENTS 2,219,811 A * 10/1940 Friedman ..... B21F 1/02 140/140
4,917,285 A * 4/1990 Shosie ..... B21C 1/12 228/5.7

(Continued)

FOREIGN PATENT DOCUMENTS

CH 542 671 A 11/1973
DE 2 341 037 A1 3/1974

(Continued)

OTHER PUBLICATIONS

English translate (JP2000176597A), retrieved date Jan. 16, 2025.*

(Continued)

*Primary Examiner* — Mohammed S. Alawadi
(74) *Attorney, Agent, or Firm* — DLA Piper LLP (US)

(57) ABSTRACT

A method of feeding an elongate workpiece to a forming machine includes: providing first and second feed units, wherein each of the feed units has a receiving device that receives a workpiece stock in a coil, and a straightening device downstream of the receiving device that straightens the workpiece before it enters the forming machine, wherein the first and second feed units are arranged on a common platform movable between first and second working positions, wherein, in the first working position of the platform, the first feed unit is arranged in a working position suitable for transferring workpiece portions to the forming machine, and the second feed unit is arranged in a setting-up position, (Continued)

and, in the second working position of the platform, the second feed unit is arranged in the working position and the first feed unit in a setting-up position.

16 Claims, 5 Drawing Sheets

(56) References Cited

U.S. PATENT DOCUMENTS

| | | | | |
|---|---|---|---|---|
| 5,020,575 | A | 6/1991 | Grabuschnig et al. | |
| 2018/0015529 | A1 * | 1/2018 | Takahashi | B21F 3/02 |

FOREIGN PATENT DOCUMENTS

| | | | | |
|---|---|---|---|---|
| DE | 10 2018 102 914 | A1 | | 8/2019 |
| DE | 10 2019 206 556 | A1 | | 11/2020 |
| DK | 3463710 | T3 | | 1/2020 |
| EP | 0 446 687 | A1 | | 9/1991 |
| EP | 0 537 464 | A1 | | 4/1993 |
| EP | 0 371 956 | B1 | | 9/1993 |
| EP | 1 864 726 | A1 | | 12/2007 |
| EP | 3 219 654 | A1 | | 9/2017 |
| EP | 3 463 710 | B1 | | 9/2019 |
| JP | 2000176597 | A | * | 6/2000 |

OTHER PUBLICATIONS

International Search Report dated Dec. 20, 2021 in counterpart International Application No. PCT/EP2021/074294 w/English translation.

Written Opinion dated Dec. 20, 2021 in counterpart International Application No. PCT/EP2021/074294.

* cited by examiner

METHOD AND APPARATUS FOR FEEDING AN ELONGATE WORKPIECE TO A FORMING MACHINE

TECHNICAL FIELD

This disclosure relates to a method and an apparatus for feeding an elongate workpiece to a forming machine.

BACKGROUND

Forming machines are machine tools which, with the aid of suitable tools, can produce smaller or larger series of formed parts with sometimes complex geometry from elongate workpieces such as wire, tube, strip or the like, in an automatic production process primarily by forming. A processing machine in the form of a forming machine can be, for example, a bending machine that produces two-dimensionally or three-dimensionally bent parts from wire material, strip material or tubular material by bending, a nail machine or a spring production machine that produces compression springs, tension springs, leg springs or other spring-type formed parts by spring winding or spring coiling. The forming machines include, for example, also straightening machines and rod preparation machines which, from supplied starting material, which may contain portions of greater or lesser curvature, can produce material which is straightened in a forming straightening operation, i.e., straight formed parts of a desired length. To efficiently produce large piece numbers of formed parts, highly productive computerized numerically controlled forming machines having numerous machine axes, which are activated in coordinated form via a control device, are used nowadays.

In the production of formed parts from wire, the wire is conveyed under control by an NC control program, from a workpiece stock to the tool region of the forming machine. The workpiece stock is provided in the form of a coil which is normally received in a receiving device. The term "coil" refers to a wire bundle wound up in the manner of a coil. The workpiece stock is kept ready in an apparatus assigned to the forming machine to feed an elongate workpiece to the forming machine. By forming tools connected downstream in the material conveying direction, the supplied wire is formed into the desired formed part. After the end of a forming operation, the finished formed part is severed from the supplied wire by a cutting device under the control of the NC control program. This operation is repeated cyclically for each formed part to be manufactured.

If, during a forming process, in which wire or else tube is processed in the form of a coil from a workpiece stock, the work is carried out at high drawing-in speeds and large piece numbers, the workpiece stock may be consumed relatively rapidly (e.g., within a few hours), and therefore has to be changed for a new workpiece stock. This change requires time even for experienced machine operators. Such unproductive downtimes cause a deterioration in the productivity of the overall system.

For this reason, it has already been proposed to use two rotatably mounted reels, e.g., on a common framework. GSW Schwabe AG, 47906 Kempen provides what are referred to as double reels. When the double reels are used, it is possible to load one reel while the other is in the working position and material is unwound. Such reels which can be loaded on both sides promise greater productivity with shorter setup times.

A similar proposal is described in DE 10 2018 102 914 A1. An apparatus that feeds wire into a production plant for machine elements of an electric machine is disclosed, comprising: a carrying unit; a first spool which can be mounted on the carrying unit to provide wire at a working position; a conveying device for conveying the provided wire to the production plant; wherein, in addition to the first spool, a second spool for providing wire can be mounted on the carrier unit; and the carrying unit is displaceable to bring either the first spool or the second spool into the working position. The conveying device can comprise a straightening section for straightening the wire. In one example, a respective conveying device is provided for the first and the second spool. This is intended to be able to achieve seamless production. Even while wire is being unrolled from the first spool and fed to the production plant, the wire of the second, full spool can be inserted into the conveying device of the second spool. That is to say that the wire which is located on the new, full spool is prepared while the production process is in operation and thereby permits a substantially seamless production during the changing of the spools.

There continues to be a need for an increase in the productivity of forming machines which operate from a relatively large workpiece stock.

It could therefore be helpful to provide a method and an apparatus for feeding an elongate workpiece to a forming machine, the use of which makes it possible to increase the productivity of the forming machine supplied therewith in comparison with the prior art.

SUMMARY

We provide a method of feeding an elongate workpiece to a forming machine having a drawing-in device, which can be operated at a specifiable drawing-in speed, to convey the workpiece to a tool region of the forming machine, the method including providing a first feed unit and a second feed unit, wherein each of the feed units has a receiving device that receives a workpiece stock in a coil, and a straightening device downstream of the receiving device that straightens the workpiece before it enters the forming machine, wherein the first feed unit and the second feed unit are arranged on a common platform movable between a first working position and a second working position, wherein, in the first working position of the platform, the first feed unit is arranged in a working position suitable for transferring workpiece portions to the forming machine, and the second feed unit is arranged in a setting-up position, and, in the second working position of the platform, the second feed unit is arranged in the working position and the first feed unit in a setting-up position, and the straightening unit of that feed unit which is in the setting-up position is positioned in an adjustment station and adjusted in an adjustment operation, the adjustment operation comprising a straightness check.

We also provide an apparatus that feeds an elongate workpiece to a forming machine having a drawing-in device, which can be operated at a varying drawing-in speed to convey the workpiece to a tool region of the forming machine, including a first feed unit and a second feed unit, wherein each of the feed units has a receiving device that receives a workpiece stock in the form of a coil, and a straightening unit connected downstream of the receiving device and straightens the workpiece before it enters the forming machine, wherein the first feed unit and the second feed unit are arranged on a common platform movable between a first working position and a second working position, wherein, in the first working position of the platform, the first feed unit is arranged in a working position suitable for transferring workpiece portions to the forming machine, and the second feed unit is arranged in a setting-up position, and, in the second working position of the platform, the second feed unit is arranged in the working position and the first feed unit in a setting-up position, and an adjustment station which is arranged and set up such that the straightening unit of that feed unit which is in the setting-up position is adjustable at the adjustment station in an adjustment operation, the adjustment operation comprising a straightness check.

DETAILED DESCRIPTION

Figure 1:
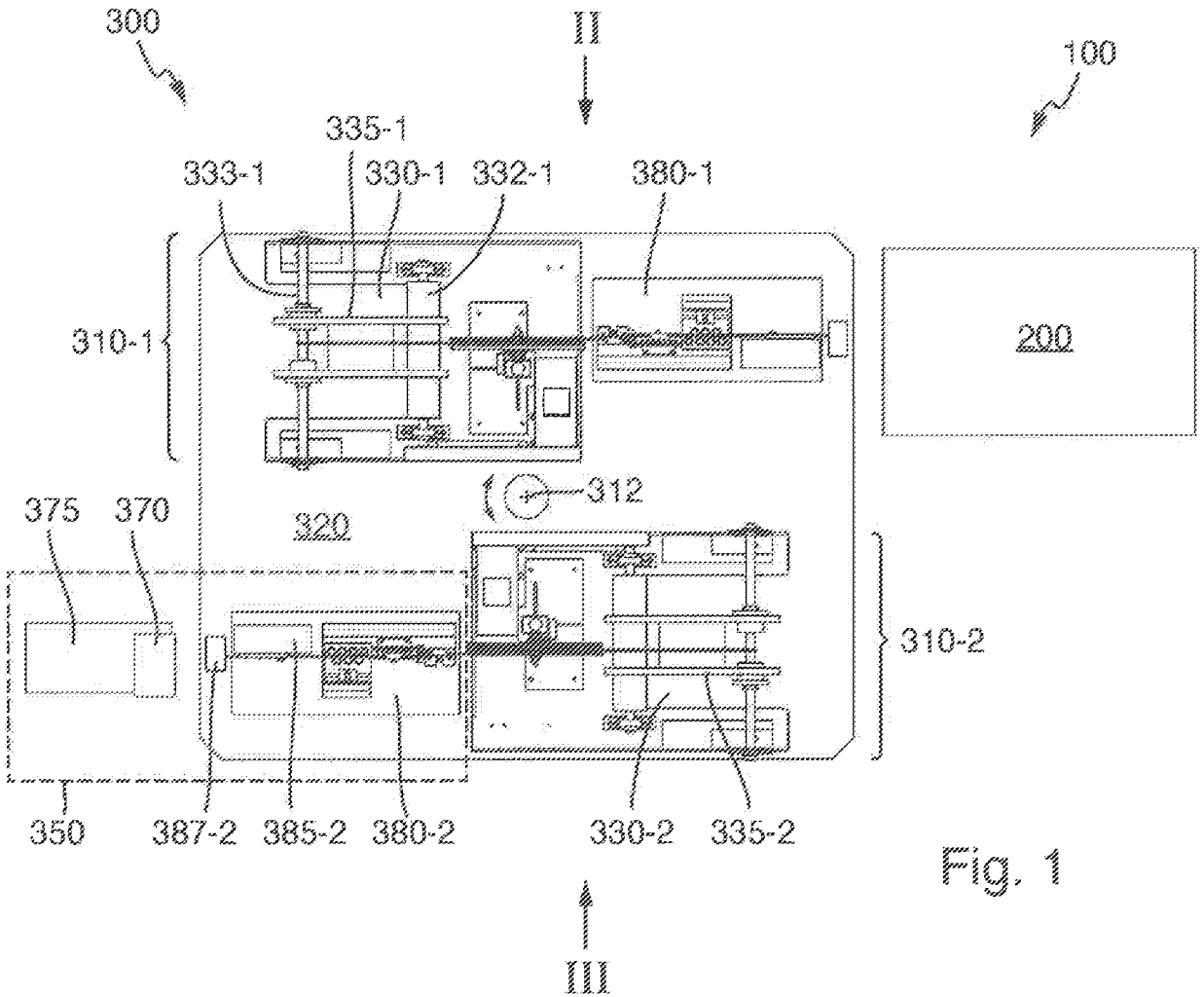
FIG. 1 shows an overall view of a wire processing plant according to an example with a rotatable platform.

The method and the apparatus serve to feed an elongate workpiece to a forming machine which has a drawing-in device, which can be operated at a specifiable drawing-in speed, for drawing in the supplied workpiece and conveying the workpiece to a tool region of the forming machine. The forming process is therefore carried out from a workpiece stock in the form of a coil, i.e., a wound wire spool. Consecutive workpiece portions are gradually pulled off from the workpiece stock and further processed in the forming machine.

To carry out the method, a first feed unit and at least one second feed unit are provided. The at least two feed units are components of the apparatus. Each of the feed units comprises a receiving device that receives a workpiece stock in the form of a coil, and a straightening unit connected downstream of the receiving device and intended to straighten the workpiece before it enters the forming machine.

The receiving devices are configured such that workpiece stocks can be exchanged in a controlled way. A receiving device can be configured, for example, to receive and rotatably mount an exchangeable reel. The reel serves as a winding-up aid and unwinding aid and can have, for example, a roll-shaped, coil-shaped or cross-shaped design and can carry the wire-shaped workpiece in wound-up form. A receiving device can also be a device of a different type which is suitable for receiving a coil, e.g., a container.

If a workpiece in the form of a wire or a tube is pulled off from a coiled workpiece stock, it generally has a curved shape at least in sections even after it is fully relaxed. To eliminate the curvature before further processing in the forming machine, each of the feed units has a straightening unit connected downstream of the receiving device and intended for straightening the workpiece before it enters the forming machine. Straightening is a method step from the group of forming methods and sets the elongate workpiece material into as straight a form as possible, i.e., into a hardly curved or curve-free state, before the further processing. For this purpose, the workpiece material is conveyed through a straightening unit. From the material, the straightening unit produces, by way of forming, material straightened in a straightening operation. A straightening unit can have, for example, one or more roller straightening apparatuses and/or at least one rotating straightening spinner.

The first feed unit and the second feed unit are arranged on a common platform which is movable between a first working position and a second working position. The platform serves as a support for the components of the feed units such that, by movement of the platform, the position and/or the orientation of the feed units in space can be changed in coordinated fashion. In the first working position of the platform, the first feed unit is arranged in a working position suitable to transfer workpiece portions to the forming machine, and the second feed unit is arranged in a setting-up position. By contrast, in the second working position of the platform, the second feed unit is arranged in the working position suitable to transfer workpiece portions into the forming machine, and the first feed unit is arranged in a setting-up position. By movement of the platform between its working positions, a change of the feed units can therefore be brought about such that either the one or the other feed unit can be brought into the working position such that workpiece material supplied with the aid of the feed unit can be received by the forming machine and further processed.

The respective other feed unit is then not in the working position and, if required, can be set up for a subsequent process during the operation of the forming machine. In particular, a change of the workpiece stock at the receiving device of that feed unit which at that moment is in the setting-up position, rather than in the working position, is possible in the setting-up position.

The setting-up position is that position of a feed unit in which all of the work for setting up the feed unit, i.e., to prepare the components of the feed unit for operative use, can be undertaken. The setting-up position may also be referred to as the setup position. In the setting-up position or setup position, that feed unit which is in the setting-up position is set up for a subsequent working operation, the working operation being able to begin when the set-up feed unit is moved into the working position and is ready there to interact with the subsequent forming machine.

A particular characteristic of the method is that the straightening unit of that feed unit which is in the setting-up position is positioned in an adjustment station and adjusted in an adjustment operation.

The suitability for carrying out the method is achieved at the apparatus by the fact that the apparatus comprises an adjustment station arranged and set up such that the straightening unit of that feed unit which is in the setting-up position is adjustable or can be adjusted at the adjustment station in an adjustment operation.

The straightening units of the feed units are therefore adjustable, which means that at least some of the components coming into contact with the workpiece can be changed in a defined manner in their position and/or orientation to influence the straightening result.

The method and the apparatus permit an adjustment of the straightening unit (of the feed unit located in the setting-up position) outside the main time used for the production process, i.e., in the downtime of the forming process. The work required to adjust the straightening unit can therefore be carried out in parallel with the main time and does not adversely affect the productivity of the overall plant.

We recognized that adjustment of the straightening unit may be highly time-consuming even for highly experienced machine operators. We thus provide that all of the measures necessary for adjusting the straightening unit can be carried out in parallel with the main time such that a machine operator can carry out the sometimes difficult adjustment tasks purposefully in peace without time pressure. If then that feed unit, the straightening unit of which is adjusted, for example, after a change in workpiece stock to the new workpiece material, is brought into the working position and the new material is inserted into the forming machine, the feed unit supplies workpiece material which has in any event already been straightened, and therefore there are defined conditions in respect of the straightening quality at the input of the forming machine.

The straightening result, i.e., the working result of the straightening operation, is preferably to be checked in advance for each new wire of a new workpiece stock before the workpiece material is fed to the forming process. For this reason, inter alia, the adjustment operation also comprises a straightness check.

In the simplest configuration, an operator can carry out a straightness check purely visually. Optionally, separate devices or aids can also be used for the straightness check, for example a gauge, a ruler or the like. The straightness check can comprise placing them onto a metal sheet which is present at the adjustment station, with a flat support surface and applying them to an edge in the wire longitudinal direction. Rotation of the material about 90° can be provided. A possibly present curvature (in both planes in profiled material) can therefore be visually determined.

The straightness check can also be undertaken with the aid of an automated device, e.g., a camera-based straightness checking device with at least one camera. The results of such a camera check can then be an instruction to the operator to adjust the straightening apparatus or, by feeding them to the controller, a straightening apparatus designed with motorized adjustment can adjust them directly to the correct values.

The straightness check can be carried out on the workpiece passing through, after it has passed through the straightening unit and before a workpiece portion is severed, or in the passing-through process, i.e., before the workpiece portion is severed.

If the straightness check reveals that the straightening quality is not yet sufficient, i.e., the straightness still does not lie within the tolerance, further adjustment operations are carried out at the straightening unit and the effect thereof checked with reference to a further severed workpiece portion. If, by contrast, the straightness lies within the tolerance, the straightening unit is fully adjusted and the feed unit prepared to this extent for a next working use.

With the aid of the method and the apparatus, it is possible to bring a feed unit with fully adjusted and inserted straightening unit very rapidly into engagement with the forming machine to be loaded, by movement of the feed unit into the working position. As a result, the overall productivity of the plant is increased by reducing setup times.

Preferably, a new workpiece stock is added to the receiving device of that feed unit located in the setting-up position and then the adjustment operation for adjusting the straightening unit to the workpiece of the new workpiece stock is carried out before the feed unit is moved into the working position by movement of the platform. Once it has arrived in the working position, the feed unit can immediately commence operation by supplying straightened workpiece material.

To carry out the cutting operation, a stationary cutting device can be arranged at the adjustment station, the cutting device then being able to be used within the course of the adjustment operations of the straightening unit to sever a straightened workpiece portion, the straightness of which is then checked. In some configurations, a manually actuated cutting device (hand cutting) is provided for this purpose. An automated cutting device with its own cutting drive may also be provided.

In some configurations, each of the feed units has a drawing-in device for conveying the workpiece through the straightening unit. The drawing-in device can be arranged, for example, downstream of the straightening unit in the passing-through direction, and therefore the workpiece is first of all guided from the receiving device through the straightening unit and the drawing-in device connected downstream draws the material to be straightened through the straightening unit.

It is not necessary for each of the feed units to have a drawing-in device for conveying the workpiece through the straightening unit. It is also possible for an external drawing-in device to be used to advance the workpiece or for the drawing-in within the scope of the adjustment operation, i.e., a drawing-in device which is not part of a feed unit and is also not located on the movable platform.

Some method configurations are distinguished in that the drawing-in device is actuated to advance the material through the straightening unit during the adjustment operation and/or to insert the workpiece into the forming machine after adjustment of the straightening unit and before the forming operation, and is disengaged from the workpiece for the operation of the forming machine. The drawing-in device can therefore be released before the productive forming operation begins. In these configurations, the drawing-in device of the feed unit is used only as an auxiliary device prior to productive operation. Since the forming machines of the type under consideration here have a dedicated drawing-in device, the task of advancing the material during the productive operation can be taken over by them and the drawing-in operation which is internal to the machine is not interfered with by the disengaged drawing-in device of the feed unit in the working position.

This measure is equally possible in configurations in which each of the feed units has a drawing-in device that conveys the workpiece through the straightening unit as in configurations with a drawing-in device which is not arranged on the platform and remains at the adjustment station.

Preferably, the platform is mounted rotatably about an axis of rotation such that a change between the first and the second working position of the platform can be carried out by rotating the platform about the axis of rotation. Therefore, with the aid of a rotational movement, a feed unit which is initially still in the setting-up position can be brought into the working position while at the same time the feed unit which is initially in the working position is moved into the setting-up position. An example with a rotatable platform can be constructed extremely compactly and in a space-saving way since in principle the two feed units which are carried by it can merely exchange places. Preferably, a rotary drive is provided to rotate the platform about the axis of rotation, and therefore rotation of the platform can be automated and carried out without intervention of a machine operator.

The first feed unit and the second feed unit can be constructed substantially identically to each other. They can be constructed on the platform such that the corresponding components of the first and the second feed unit are each arranged substantially point-symmetrically with respect to a point of symmetry lying on the axis of rotation of the platform. A uniform distribution of weight of the components of the feed unit with a mass center of gravity on the axis of rotation is therefore possible, thus resulting in a stable and easily rotated assembly. Even if the receiving devices are loaded unequally, these advantages largely continue to be maintained.

A further advantage of an example with a rotatable platform is that the apparatus can be constructed such that it has just a single adjustment station. The straightening units of the feed units are then alternately rotated into the adjustment station by rotation of the platform.

In some examples, a stationary drawing-in device, i.e., a drawing-in device which is not movable with the platform, is arranged at the adjustment station and is set up to interact, during an adjustment operation, with the straightening unit of that feed unit which is in the setting-up position. This drawing-in device can be used in the manner of an auxiliary drawing-in device to draw workpiece material through the straightening unit while adjustment work is being undertaken at the straightening unit. The drawing-in device therefore does not have any task within the scope of the productive operation of the forming machine.

Alternatively, the platform is mounted in a linearly displaceable manner such that a change between the first and the second working position can be carried out by a linear displacement of the platform in a displacement direction. In this example, the first feed unit and the second feed unit can be constructed parallel to each other such that those sides which face the forming machine in the working position are located on the same side of the platform. In this example, two setting-up positions are required, as a result of which more space is required than for the rotatable configuration.

The receiving devices of the feed units can differ in design. In some configurations, the workpiece stock is provided in the form of a coil on a rotatably mounted reel. The exchangeable reel is received by the receiving device. Depending on the configuration, it can be actively drivable with the aid of a reel drive or else designed as a passively rotatable reel which is set into rotation by workpiece material being drawn off from it. To permit a simple change of coils, the axes of rotation of the reels are preferably oriented horizontally, but this is not compulsory. An arrangement with vertical axes of rotation of the reels is also possible. A receiving device can also have a non-rotatable, e.g., barrel-like, container, into which a workpiece stock in the form of a coil can be placed.

A task of the feed units is feeding the workpiece material at a suitable speed profile to the forming machine or the drawing-in device thereof. This may be a challenge in particular in forming machines operating with high dynamics and which optionally operate with an intermittent drawing-in operation and/or at greatly fluctuating drawing-in speeds and sharp accelerations. Despite the great accelerations sometimes required, to achieve a controlled drawing off of a workpiece from the workpiece stock at the drawing-in device of the forming machine, devices are preferably provided in order to at least partially compensate for such existing nonuniformities in the drawing-off of the material and to ensure a smoother operation.

For this purpose, a movably mounted deflecting device, for example, in the form of a deflecting pulley and/or a movably mounted pivoting arm, can be provided between the receiving device and the straightening unit of a feed unit to compensate for tension and length.

Alternatively or additionally, it is also possible for a buffer store which can receive a workpiece loop of variable length to be provided between the receiving device and the straightening unit of a feed unit.

In some configurations of feed units, an auxiliary drawing-in device is provided between the receiving device and the straightening unit, which auxiliary drawing-in device is connected downstream of the receiving device and which is drivable by an auxiliary drive and configured to convey the workpiece at a specifiable conveying speed to a buffer store connected downstream. The latter has an inlet and an outlet for the workpiece, wherein the buffer store is designed such that the workpiece can form a workpiece loop of variable length in the buffer store between the inlet and the outlet. Furthermore, a sensor system is provided to detect a degree of filling of the buffer store and generate sensor signals representing the degree of filling, wherein the control device of the apparatus is configured such that the conveying speed of the auxiliary drawing-in device can be controlled depending on the sensor signals of the sensor system.

When this configuration is used, it is possible during the productive operation, to feed the required workpiece material to the drawing-in device of the forming machine always in a matching movement state, even if the drawing-in device is operated with sharp fluctuations of the drawing-in speed even as far as the stop-and-go mode. It is therefore possible to decouple the region of the supply of the workpiece (including workpiece stock) from the region of the processing of the workpiece at the interface between feed unit and forming machine such that the workpiece feed does not uncontrollably impair the processing operations at the forming machine.

Figure 2:
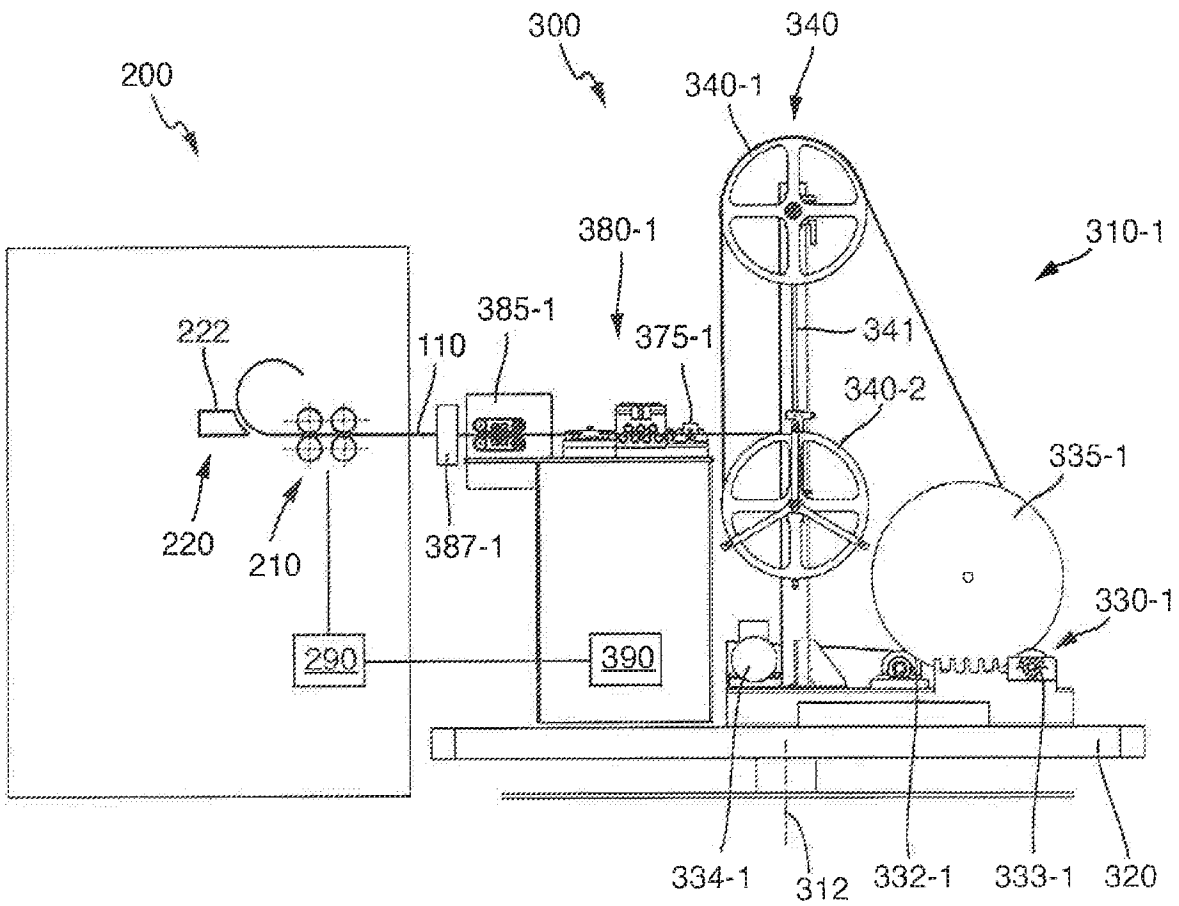
FIG. 2 shows the wire processing plant in a side view in viewing direction II from FIG. 1.
Figure 3:
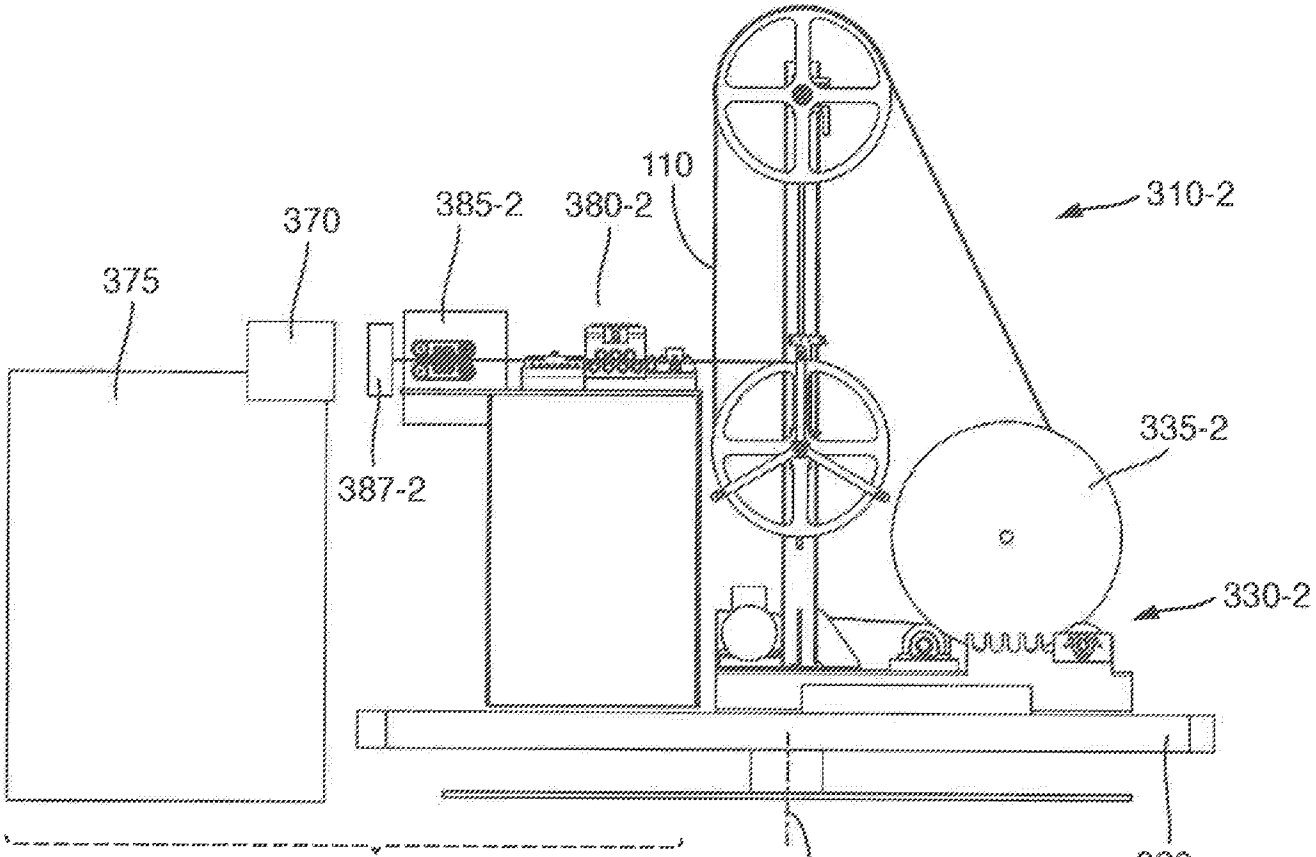
FIG. 3 shows a side view corresponding to the viewing direction III in FIG. 1.

FIG. 1 shows an overall view of a wire processing plant 100 according to a first example from above. Schematic FIG. 2 shows the wire processing plant in a side view in viewing direction II from FIG. 1. FIG. 3 shows a side view corresponding to the viewing direction III in FIG. 1.

The wire processing plant 100 is designed and set up to process elongate workpieces 110 in the form of metallic wires which are available as a workpiece stock in the form of what is referred to as a coil, i.e., a wire bundle wound up in the manner of a spool. From the workpiece material, which is present originally in a great length on the workpiece stock, piece numbers of greater or lesser size of identical formed parts are produced in a forming process in a computerized numerically controlled manufacturing process. The formed parts can be, for example, helical springs, in particular compression springs or tension springs, or else bent parts of different geometry.

In other examples of forming machines, formed parts that are not identical can also be produced. Formed parts can generally be bent two-dimensionally or three-dimensionally, and optionally can also be straight (e.g., in straightening machines or rod preparation machines).

The wire processing plant 100 comprises a forming machine 200 which can be configured as a spring winding machine in production of helical springs, for example. Furthermore, an apparatus 300 connected upstream in the material flow direction of the forming machine and intended for feeding elongate, wire-shaped workpiece material to the forming machine 200 is provided. The apparatus 300 is also referred to as "feed apparatus 300."

The forming machine 200 comprises a drawing-in device 210 which is connected to the control unit 290 of the forming machine and, under the control by an NC control program, conveys wire 110, which is supplied by the feed apparatus 300, into the tool region 220 of the forming machine, in which a forming tool or a plurality of forming tools 222 is or are arranged. The forming tools which are connected downstream in the material conveying direction form the supplied wire into a helical spring or (in other forming machines) into a different formed part. After the forming operation is finished, the complete formed part is severed from the supplied wire by a cutting device, not illustrated, under the control by the NC control program. This operation is repeated cyclically for each formed part to be manufactured.

The advancing of the wire to the tool region 220 or the drawing-in of the wire by the drawing-in device 210 is intended to take place in accordance with a speed profile specific to the manufacturing process and has a time-dependently varying drawing-in speed. For this purpose, the drawing-in device 210, which can be configured, for example, as a roll draw-in or belt draw-in, is correspondingly activated. One task of the feed apparatus 300 is the wire being fed at all times as accurately as possible at the speed required at this time to the drawing-in device 210 of the forming machine. The feed apparatus 300 has a dedicated control unit 390 which communicates with the control unit 290 of the forming machine. The functionalities of the two control units can be integrated in one single control unit.

The feed apparatus 300 comprises a first feed unit 310-1 (cf. side view in FIG. 2) and a second feed unit 310-2 (cf. side view in FIG. 3). The two feed units 310-1, 310-2 are arranged on a common platform 320 which, in the variant illustrated, is substantially in the form of a horizontally oriented plate which serves as a common carrying unit for the two feed units. In this example, the common platform 320 is mounted rotatably about a vertical axis of rotation 312, and therefore a change between a first working position and a second working position can be carried out by rotation of the platform 320 by 180° about the axis of rotation 312. To carry out the rotation, a rotary drive, not illustrated, is provided which is connected to the control unit 390 and is controlled by the latter.

FIG. 1 shows the platform 320 in a first working position, in which the first feed unit 310-1 is arranged in a working position which is suitable for transferring workpiece portions to the forming machine 200. By contrast, the second feed unit 310-2 is arranged in a setting-up position or setup position. In the setting-up position, the second feed unit 310-2 can be set up for a subsequent working operation. The activities provided for this purpose take place within the scope of a setting-up operation, with which the second feed unit is prepared to be fully functional, and therefore, after being pivoted from the setting-up position into the working position, it can cooperate virtually without any loss of time with the forming machine 200 then connected downstream.

The first feed unit 310-1 and the second feed unit 310-2 are constructed substantially identically to each other, i.e., have the same components in the same relative arrangement. The components are arranged substantially spot-symmetrically with respect to a point of symmetry lying on the axis of rotation 312.

Each of the feed units 310-1, 310-2 has a receiving device that receives a workpiece stock in the form of a coil and a straightening unit that straightens the workpiece before it enters the forming machine, the straightening unit being connected downstream of the associated receiving device in the material flow direction. The first feed unit 310-1, which is shown in side view in FIG. 2, therefore has a first receiving device 330-1 and a first straightening unit 380-1 which is arranged in the vicinity of the forming machine 200 in the first working position shown. The second feed unit 310-2, which is shown in side view in FIG. 3, has a second receiving device 330-2, with the second straightening unit 380-2 being connected downstream of it in the material flow direction.

The feed apparatus 300 comprises an adjustment station 350 which is arranged and set up to permit a machine operator to undertake, at that straightening unit which is located in the adjustment station, all of the work which is required to adjust the straightening unit located there to the passed-through workpiece material such that, during the productive operation, i.e., whenever the feed unit is in its working position, the feed unit can supply straightened workpiece material with high straightening quality. In the situation of FIG. 1, the second straightening unit 380-2 is located in the region of the adjustment station 350 and can be adjusted in an adjustment operation (cf. FIG. 3).

Before an adjustment operation is described in more detail, the design of the first feed unit 310-1 will first of all be explained in more detail with reference to FIGS. 1 and 2. The workpiece stock (coil) is kept ready on an exchangeable reel 335-1 which is received by a receiving apparatus 330-1 and, in the received state, is mounted rotatably about a horizontal axis of rotation. The mounting does not take place here in the region of the axis of rotation of the reel. Instead, two axially parallel carrying rollers 332-1, 333-1 with horizontal axes of rotation are attached to the platform 320. These carrying rollers are part of the receiving apparatus 330-1. The reel is placed onto the two carrying rollers such that the circumference of the disk-shaped side elements of the reel rests on the two carrying rollers and the position of the axis of rotation in space is determined. The example involves an active reel with a dedicated drive. The drive 334-1 is in engagement with the front carrying roller 333-1 and can drive the latter under control by the control unit 390.

The unwound wire is guided via a deflecting device 340 which has an upper deflecting pulley 340-1 and a lower deflecting pulley 340-2 mounted rotatably axially parallel on a vertical support 341. The upper deflecting pulley is a vertically movable dancer pulley with spring resetting. The drive motor for the carrying/drive roller is controlled by positional interrogation of the pulley. The lower deflecting pulley is looped around approximately over three quarters of its circumference such that the outlet, i.e., the upper side of the lower deflecting pulley 340-2, lies level with the passage opening in the first straightening unit 380-1.

The wire is therefore guided substantially horizontally from the lower deflecting pulley to the first straightening unit 380-1. A wire guiding device 375-1, the output of which is aligned with the input of the first straightening unit 380-1 connected downstream, is located between the deflecting device and the straightening unit. A wire end recognition device can be integrated in the wire guiding device.

The first straightening unit 380-1 comprises two roller straightening apparatuses connected downstream of one another and which each have a number of (e.g., from three to nine) axially parallel straightening rollers, wherein the axes of rotation of the straightening rollers of the straightening apparatuses connected consecutively are oriented orthogonally to one another. The axial positions of the individual straightening rollers are individually adjustable to be able to adjust the operative geometry of the straightening unit. Due to the multiplicity of degrees of freedom in the adjustment, a machine operator with many years of experience is required to adjust a straightening unit. In every instance, the adjustment operation requires a considerable amount of time.

The straightening unit 380 is carried by a framework part in which the control unit 390 of the feed unit can also be accommodated. The framework part also carries a first drawing-in device 385-1 arranged downstream of the first straightening unit 380-1 in the material flow direction and serves inter alia to draw the wire material through the straightening unit in the direction of following components. In the example, the drawing-in device 385-1 is configured as a belt drawing-in device and, in other examples, may also be configured as a roll draw-in or draw-in by tongs. The drawing-in device 385-1 is important within the scope of the adjustment operation. The drawing-in device could also be arranged upstream of the straightening unit.

Downstream of the drawing-in device 385-1 in the material flow direction, there is an optional, manually actuable clamping device 387-1 with which the axial position of the passed-through wire can be fixed when required.

As already mentioned, in the situation illustrated in FIG. 1 the straightening unit 380-2 of the second feed unit 310-2 and the second drawing-in device 385-2 which is connected downstream and the second clamping device 387-2 which is arranged downstream thereof are located on the platform 320 in the region of the adjustment station 350.

The adjustment station 350 furthermore comprises components that are only present once in the feed device 300, specifically stationarily outside the platform 320 in the region of the adjustment station 350. These components include a stationary cutting device 370 with which, during the adjustment work at the straightening unit, workpiece portions straightened by way of a trial are cut off from the supplied wire and therefore provided for a straightness test. In the example, a manually actuable cutting device 370 is provided. Alternatively, an automated cutting device can be provided. Next to and below the cutting device 370 a depositing device 375 is provided which is a depositing place for severed workpiece portions and can be used, for example, in the straightness check.

The depositing device 375 has, on its upper side, a flat depositing surface with a lateral protruding border such that a lateral straight inner edge is formed. When checking round material, an operator can roll the severed piece of wire manually along the depositing surface and, in the process, can determine the rolling resistance and/or the uniformity/nonuniformity of the rolling and use it as a measure for the straightness. When it is placed against the border, the straightness can likewise be checked. In flat material (e.g., with a rectangular cross section), the straightness can be checked in two orthogonal planes by placing the wire piece against the depositing surface and the border.

During operation of the wire processing plant 100, all of the straightening work can be undertaken at a feed unit including all activities in conjunction with the correct adjustment of the straightening unit while the other feed unit is in its working position upstream of the forming machine and can feed wire to the latter. In conjunction with FIG. 1, it is assumed that the second feed unit 310-2 was used previously before the associated wire stock was used up or was separated by a cutting device before the wire end was reached in reaction to a signal of a sensor that identifies the filling level of the reel. The platform 320 was then automatically rotated under drive control by 180° in the clockwise direction to bring the first feed unit 310-1 into the illustrated working position for cooperation with the forming machine 200 connected downstream.

The second feed unit 310-2 is then in the setting-up position. First, the empty reel is removed from the carrying rollers and replaced by a full reel with fresh wire material. A piece of drawn-off wire is then guided over the two deflecting pulleys of the deflecting device and introduced through the wire guide into the straightening unit 380-2 and through the latter into the following drawing-in device 385-2.

It is generally not assumed that the straightening unit 385-2 in the setting in which sufficiently good straightening results were obtained for the previously used up wire also delivers sufficiently good straightening results from the beginning for the new wire material. Therefore, when changing the wire, the straightening unit generally has to be adjusted to the new wire material. For this purpose, a workpiece portion of a certain length is drawn with the aid of the drawing-in device 385-2 through the straightening unit 380-2 and conveyed forward to such an extent that the straightened workpiece portion is severed from the supplied wire with the aid of the cutting device 370 and drops onto the rod store 375.

The machine operator can now carry out a straightness check on the wire portion. If it is round wire, the wire can be rolled, for example, manually on a flat depositing surface of the depositing device 375 to see whether the rolling takes place sufficiently uniformly or, because of an impermissible curvature, the rolling resistance depends greatly on the rotational position of the wire piece. If the straightness check shows that the straightness is not yet within the tolerance, changes to the settings at the straightening unit 380-2 have to be undertaken. The machine operator carries these out and then, after the next workpiece portion is straightened, checks whether the straightness has improved as a result. In this way, the straightening unit 380-2 can be iteratively adjusted to the new workpiece material.

During the adjustment operation, the drawing-in device 385-2 is an auxiliary draw-in, i.e., as an aid within the scope of the adjustment operation to advance consecutive workpiece portions each following adjustment steps to the straightening unit 380-2. If the desired straightening quality has been reached, the wire end can be firmly clamped with the aid of the manual clamping device 387-2. The second feed unit 310-2 is then prepared for the productive operation.

If the workpiece stock at the feed unit located in the working position has been used up, the fully set-up second feed unit with the fresh workpiece stock can be rotated into the working position by rotation of the platform about 180°. Subsequently, the front wire end merely has to be inserted into the forming machine or into the drawing-in apparatus 210 thereof. Within the scope of this substep, the drawing-in device 385-2 can likewise be used as an auxiliary draw-in to advance the wire to such an extent that it can be grasped and conveyed by the drawing-in device of the forming machine. From this time, the drawing-in device 385-2 of the feed unit has carried out its tasks within the scope of the adjustment of the straightening unit and within the scope of inserting the new wire and is released, i.e., disengaged from the wire passing through. From this time, the drawing-in device of the forming machine then takes over the controlled advancing of the wire.

The concept presented here has the advantage, inter alia, that a completely adjusted and threaded straightening unit can be brought very rapidly into engagement with the forming machine. As a result, the overall productivity of the wire processing plant can be increased since all of the work required for the setting-up activities can be carried out in parallel with the main time.

In an example, not illustrated graphically, it is possible to carry out the straightness test in automated fashion at the cut-off rod-shaped workpiece portions or before the workpiece portions are severed from the wire with the aid of at least one camera. For example, in flat material, two cameras offset by 90° can be used to check the straightness even during the pass. In particular in round wires, a camera rotating about the wire could be usable.

By feedback and control, it is possible to activate a straightening unit, which is adjustable by motor, and thereby to undertake the adjustment operation fully automatically under sensor control.

Figure 4:
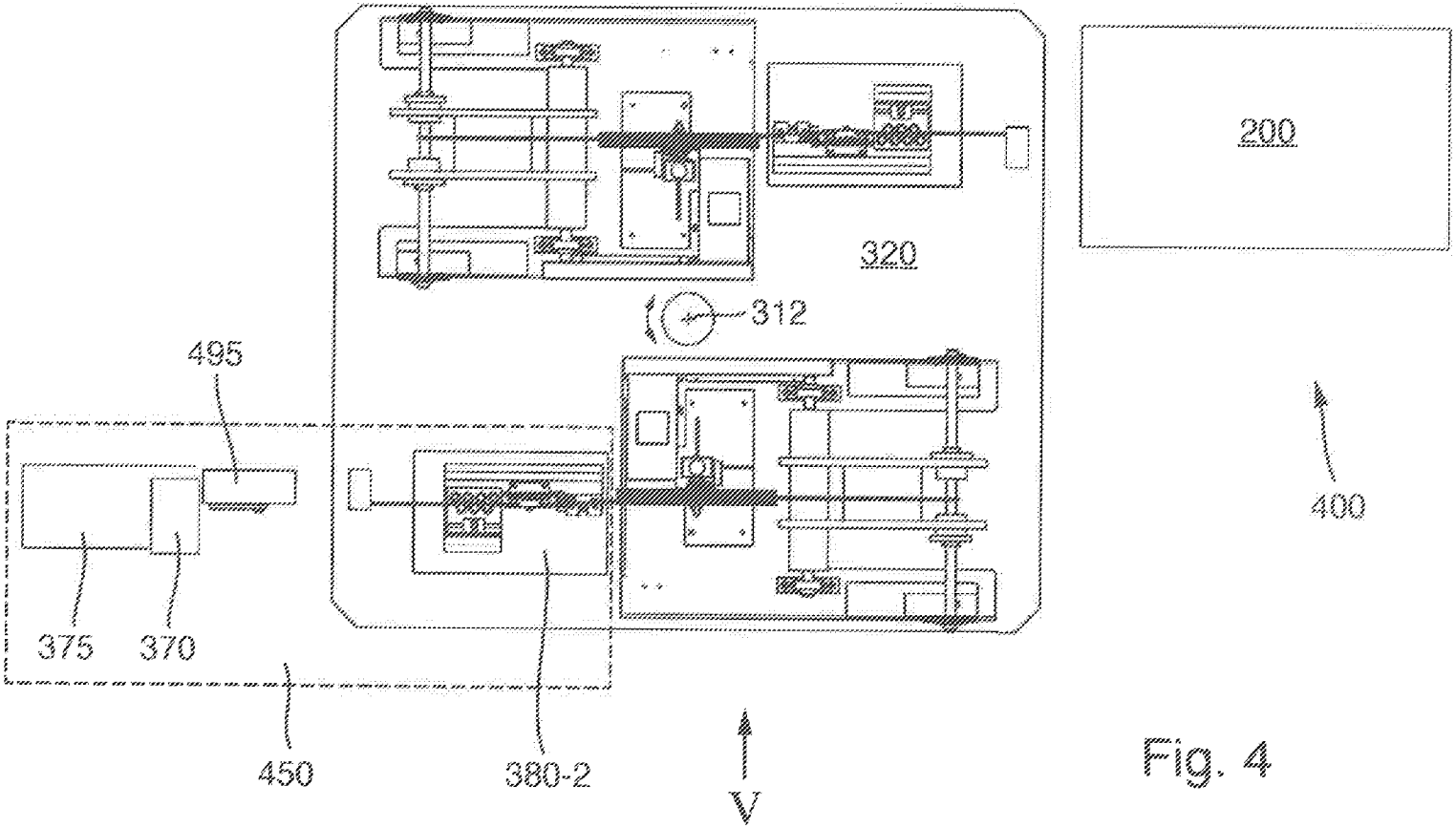
FIG. 4 shows an overall view of a wire processing plant according to another example with a rotatable platform.

FIG. 4 shows a schematic top view of a second example of a wire processing plant 400. The latter corresponds in many aspects to the first example of FIGS. 1 to 3, and therefore the same reference signs are used for those components which are present in the same way in the first example.

A first difference over the first example is that the two feed units on the platform each do not have a drawing-in device attached to the platform 320 downstream of the corresponding straightening unit 380-1 or 380-2 in the material passing-through direction. None of the feed units therefore comprises a drawing-in device that conveys the workpiece through the straightening unit. The functionality of the draw-in during the adjustment work at the straightening unit 380-2 in the adjustment station 450 is taken over here by a stationary drawing-in device 495 arranged next to the rotatable platform 320 between the latter and the following cutting device 370. Within the scope of the adjustment operation at the adjustment station 450, the drawing-in device 485 takes on the task of stepwise advancing of the material to convey straightened workpieces gradually and repeatedly in the direction of the subsequent cutting device and the depositing device 375, the workpieces then being subjected there to a straightness check. The drawing-in device 485 can likewise be configured as a belt draw-in or roller draw-in. This example has the advantage over the first example that a drawing-in device can be omitted. However, there is then no dedicated auxiliary draw-in for the task of inserting a new piece of wire at the forming machine 200, and therefore the drawing-in movement has to be assisted manually until the piece of wire is inserted into the forming machine.

Figure 5:
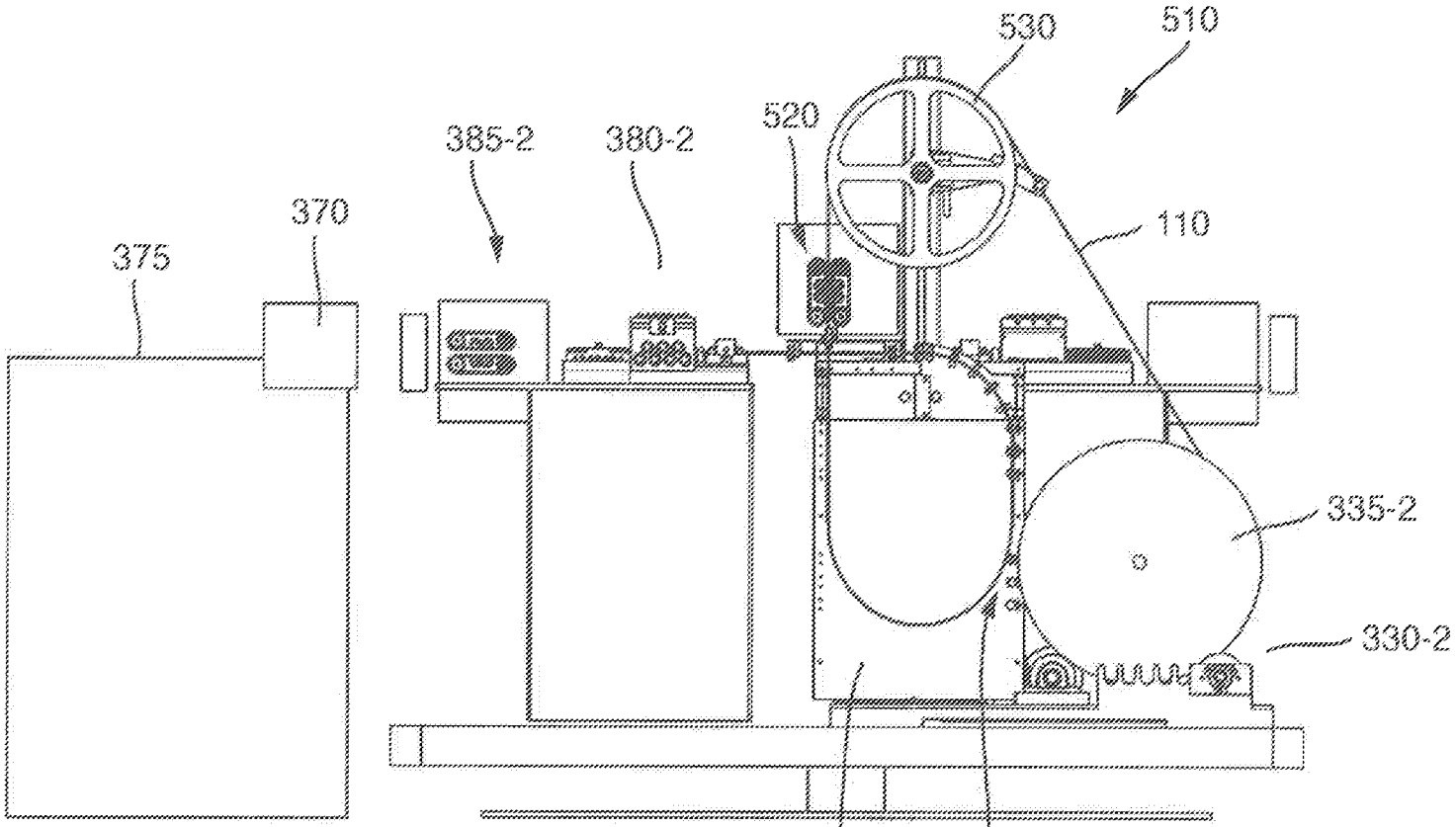
FIG. 5 shows the wire processing plant in a side view in viewing direction V from FIG. 4.

FIG. 5 shows a side view of an example of a feed unit 510, the design of which can be identical to the first example in respect of the arrangement of the straightening unit with the drawing-in device connected downstream, and therefore the same reference signs are used for corresponding components. The feed unit 510 is illustrated in its setting-up position, in which the cutting device 370 and the rod depositing device 375 are located downstream of the drawing-in device 385-2 in the material running direction. The reel 335-2 is a draw-off reel, i.e., a passive reel without its own drive, the rotation of which is brought about by the workpiece material being drawn off from the outer circumference of the wire bundle. Further differences include substantially only in the manner of guiding the wire drawn off from the draw-off reel between the reel and the straightening unit.

In this example, an auxiliary drawing-in device 520 is provided between the receiving device 330-2 for the reel 335-2 and the straightening unit 380-2, the auxiliary drawing-in device being connected downstream of the receiving device and, in the example, being configured as a vertically oriented belt draw-in and conveying the wire, which runs downward from the deflecting pulley 530, downward in the vertical direction. The auxiliary drawing-in device is drivable with the aid of an auxiliary drive, not illustrated, which can be controlled by the control device 390 of the feed apparatus. In the material running direction downstream of the auxiliary drawing-in device there is a buffer store 550 that receives a vertically hanging workpiece loop of variable length. The auxiliary drawing-in device or the auxiliary drive can convey the workpiece (wire) at a specifiable conveying speed to the buffer store connected downstream. The buffer store has an inlet, through which the wire can enter the buffer store in the vertical direction, and an outlet, through which the wire can emerge in the horizontal direction approximately coaxially with respect to the passing-through direction of the straightening unit. The buffer store is designed such that the workpiece can form a workpiece loop of variable length in the buffer store between the inlet and the outlet. A sensor system 560 is provided to detect the degree of filling of the buffer store. The sensor system generates sensor signals which represent the degree of filling of the buffer store. The control unit of the apparatus can receive and process the sensor signals and is configured such that the conveying speed of the auxiliary drawing-in device 520 can be controlled depending on the sensor signals of the sensor system 560.

The invention claimed is:

1. A method of feeding an elongate workpiece to a forming machine having a drawing-in device, the drawing-in device is operated at a specifiable drawing-in speed, to convey the workpiece to a tool region of the forming machine, the method comprising:

providing a first feed unit and a second feed unit, wherein each of the first feed unit and the second feed unit has a receiving device that receives the elongate workpiece in a coil, and a straightening unit downstream of the receiving device that straightens the workpiece before the workpiece enters the forming machine, wherein the first feed unit and the second feed unit are arranged on a common platform movable between a first working position and a second working position, wherein, in the first working position of the platform, the first feed unit is arranged in a working position suitable for transferring portions of the elongate workpiece to the forming machine, and the second feed unit is arranged in a setting-up position, and, in the second working position of the platform, the second feed unit is arranged in the working position and the first feed unit in a setting-up position, and providing an adjustment station, wherein in each of the setting-up position of the first working position and the second working position the straightening unit is positioned in the adjustment station to adjust the straightening unit in an adjustment operation, the adjustment operation comprising a straightness check.

2. The method as claimed in claim 1, feeding a new workpiece stock to the receiving device of whichever feed unit which is in the setting-up position and then the adjustment operation that adjusts the straightening unit to align the straightening unit with the workpiece of the new workpiece stock is carried out before said feed unit is moved by movement of the platform into the working position.

3. The method as claimed in claim 1, wherein, during the adjustment operation, a portion of the elongate workpiece, after passing through the straightening unit, is severed from the supplied workpiece material in a cutting operation and the straightness check is carried out on the severed portion of the elongate workpiece.

4. The method as claimed in claim 1, wherein the straightness check is carried out on the workpiece passing through after the workpiece has passed through the straightening unit and before a portion of the elongate workpiece is severed.

5. The method as claimed in claim 1, actuating the drawing-in device to advance the elongate workpiece through the straightening unit during the adjustment operation and/or to insert the workpiece into the forming machine after adjustment of the straightening unit and before the forming operation, and is disengaged from the workpiece during the operation of the forming machine.

6. The method as claimed in claim 1, wherein a change between the first working position and the second working position is carried out by rotation of the platform about an axis of rotation.

7. An apparatus for feeding an elongate workpiece to a forming machine having a drawing-in device, the drawing-in device is operated at a varying drawing-in speed to convey the workpiece to a tool region of the forming machine, comprising:

a first feed unit and a second feed unit, wherein each of the first feed unit and the second feed unit has a receiving device that receives a portion of the elongate workpiece in the form of a coil, and a straightening unit connected downstream of the receiving device and straightens the workpiece before the workpiece enters the forming machine, wherein the first feed unit and the second feed unit are arranged on a common platform movable between a first working position and a second working position, wherein, in the first working position of the platform, the first feed unit is arranged in a working position suitable for transferring portions of the elongate workpiece to the forming machine, and the second feed unit is arranged in a setting-up position, and, in the second working position of the platform, the second feed unit is arranged in the working position and the first feed unit in a setting-up position, and an adjustment station, wherein in each of the setting-up position of the first working position and the second working position the straightening unit is positioned in the adjustment station to adjust the straightening unit in an adjustment operation, the adjustment operation comprising a straightness check.

8. The apparatus as claimed in claim 7, wherein a device is provided for the straightness check, the device for the straightness check being selected from the group consisting of:

a support device with a flat support surface, wherein the support surface is oriented horizontally or oriented obliquely as a rolling surface with an inclination, a lateral protruding border is provided such that a lateral straight inner edge is formed, and a camera-based straightness measurement system.

9. The apparatus as claimed in claim 7, wherein a stationary cutting device is arranged at the adjustment station.

10. The apparatus as claimed in claim 7, wherein each of the first feed unit and the second feed unit has a drawing-in device that conveys the workpiece through the straightening unit.

11. The apparatus as claimed in claim 7, wherein the platform is mounted rotatably about an axis of rotation such that a change between the first working position and the second working position is carried out by rotating the platform about the axis of rotation.

12. The apparatus as claimed in claim 11, further comprising a rotary drive configured to rotate the platform about the axis of rotation.

13. The apparatus as claimed in claim 11, wherein the apparatus has just a single adjustment station.

14. The apparatus as claimed in claim 11, wherein a stationary drawing-in device is arranged at the adjustment station, the stationary drawing-in device being set up, during the adjustment operation, to interact with the straightening unit of that feed unit which is in the setting-up position.

15. The apparatus as claimed in claim 7, wherein the platform is mounted in linearly displaceable manner such that a change between the first working position and the second working position is carried out by a linear displacement of the platform in a displacement direction.

16. The apparatus as claimed in claim 7, wherein an auxiliary drawing-in device is provided between the receiving device and the straightening unit, the auxiliary drawing-in device being connected downstream of the receiving device, and the auxiliary drawing-in device is drivable by an auxiliary drive, and the auxiliary drawing-in device is configured to convey the workpiece at a specifiable conveying speed to a buffer store connected downstream and operates such that the workpiece can form a workpiece loop of variable length in the buffer store between an inlet and an outlet, wherein a sensor system is provided to detect a degree of filling of the buffer store and the sensor system is configured to generate sensor signals representing the degree of filling, wherein a control device is configured to control the conveying speed of the auxiliary drawing-in device depending on the sensor signals of the sensor system.

* * * * *